US010458380B2

(12) United States Patent
Zhang et al.

(10) Patent No.: US 10,458,380 B2
(45) Date of Patent: Oct. 29, 2019

(54) METHODS AND SYSTEMS FOR A FUEL INJECTOR

(71) Applicant: Ford Global Technologies, LLC, Dearborn, MI (US)

(72) Inventors: Xiaogang Zhang, Novi, MI (US); Jianwen James Yi, West Bloomfield, MI (US); Joseph F. Basmaji, Waterford, MI (US); Mark Meinhart, Dexter, MI (US); Sangjin Hong, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 50 days.

(21) Appl. No.: 15/921,516

(22) Filed: Mar. 14, 2018

(65) Prior Publication Data

US 2019/0285038 A1 Sep. 19, 2019

(51) Int. Cl.

| | |
|---|---|
| ***F02M 61/18*** | (2006.01) |
| ***F02B 17/00*** | (2006.01) |
| ***F02M 63/00*** | (2006.01) |
| ***F02B 3/02*** | (2006.01) |

(52) U.S. Cl.

CPC ..... *F02M 61/1893* (2013.01); *F02B 3/02* (2013.01); *F02B 17/005* (2013.01); *F02M 61/188* (2013.01); *F02M 61/1833* (2013.01); *F02M 63/0063* (2013.01)

(58) Field of Classification Search

CPC ..... F02M 61/1893; F02M 61/188; F02M 61/1833; F02M 63/0063; F02B 3/02; F02B 17/005

USPC ..... 123/470, 467; 239/533.12

See application file for complete search history.

(56) References Cited

U.S. PATENT DOCUMENTS

| | | | | |
|---|---|---|---|---|
| 2,967,796 | A | 1/1961 | Raffel | |
| 4,069,978 | A * | 1/1978 | El Moussa | F02M 61/1806 219/121.13 |
| 4,566,634 | A * | 1/1986 | Wiegand | F02M 57/00 123/585 |
| 6,644,565 | B2 * | 11/2003 | Hockenberger | F02M 61/1806 239/533.12 |
| 7,418,940 | B1 | 9/2008 | Yi et al. | |
| 7,942,349 | B1 * | 5/2011 | Meyer | F02M 61/08 123/294 |
| 8,899,500 | B2 * | 12/2014 | Kuzuma | F02M 21/0266 239/499 |
| 9,587,606 | B2 | 3/2017 | Anders et al. | |
| 9,657,701 | B2 * | 5/2017 | Kato | F02M 61/1893 |
| 9,664,160 | B2 * | 5/2017 | Park | F02M 51/0671 |
| 9,840,994 | B2 | 12/2017 | Zhang | |

(Continued)

OTHER PUBLICATIONS

Kurtz, E. et al., "Methods and Systems for a Fuel Injector," U.S. Appl. No. 15/461,238, filed Mar. 16, 2017, 61 pages.

(Continued)

*Primary Examiner* — Hai H Huynh

(74) *Attorney, Agent, or Firm* — Geoffrey Brumbaugh; McCoy Russell LLP

(57) ABSTRACT

Methods and systems are provided for a fuel injector. In one example, a system may include forming an annular venturi passage between an outlet surface of the fuel injector and a nozzle. The nozzle may further comprise one or more air entraining features that may work in concert with the annular venturi passage to promote air-fuel mixing.

20 Claims, 5 Drawing Sheets

(56) References Cited

U.S. PATENT DOCUMENTS

| | | | | |
|---|---|---|---|---|
| 9,845,780 | B2 | 12/2017 | Zhang | |
| 9,932,875 | B2 | 4/2018 | Zhang | |
| 10,077,724 | B1 * | 9/2018 | Kurtz | F02M 25/03 |
| 2001/0025892 | A1 * | 10/2001 | McCoy | F02B 43/00<br>239/589 |
| 2010/0123031 | A1 | 5/2010 | Weber | |
| 2012/0125293 | A1 * | 5/2012 | Choi | F02M 61/162<br>123/470 |
| 2015/0285201 | A1 * | 10/2015 | Serizawa | F02M 61/184<br>239/584 |

OTHER PUBLICATIONS

Kurtz, E., "Methods and Systems for a Fuel Injector," U.S. Appl. No. 15/804,965, filed Nov. 6, 2017, 51 pages.

Zhang, X. et al., "Fuel Injector," U.S. Appl. No. 15/841,036, filed Dec. 13, 2017, 31 pages.

* cited by examiner

METHODS AND SYSTEMS FOR A FUEL INJECTOR

FIELD

The present description relates generally to methods and systems for a fuel injector comprising air entrainment features.

BACKGROUND/SUMMARY

In diesel and gasoline engines, air is drawn into a combustion chamber during an intake stroke by opening one or more intake valves. Then, during the subsequent compression stroke, the intake valves may be closed, and a reciprocating piston of the combustion chamber compresses the gases admitted during the intake stroke, increasing the temperature of the gases in the combustion chamber. Fuel is then injected into the hot, compressed gas mixture in the combustion chamber, resulting in combustion of the fuel. In a diesel engine, the fuel may combust with the air in the combustion chamber due to the high temperature of the air, and may not be ignited via a spark plug as in a gasoline engine. The combusting air-fuel mixture pushes on the piston, driving motion of the piston, which is then converted into rotational energy of a crankshaft.

Diesel and/or gasoline fuels may not mix evenly with the air in the combustion chamber, which may lead to the formation of dense fuel pockets. These dense regions of fuel may produce soot (e.g., unburned fuel). Particulate filters may be arranged in an exhaust passage to decrease an amount of soot and other particulate matter from vehicle emissions. However, particulate filters may lead to increased manufacturing costs and may not solve fuel economy issues associated with unburned fuel.

Modern technologies for combating engine soot output may include features for entraining air with the fuel prior to injection. One or more passages may be arranged in the injector body, either as an insert in the engine head deck surface or in the engine head. Air from the combustion chamber may mix with the fuel, thereby cooling the injection temperature while simultaneously entraining air with fuel. A lift-off length may be lengthened and start of combustion may be retarded, thereby limiting soot production through a range of engine operating conditions, reducing the need for a particulate filter.

However, the inventors herein have recognized potential issues with such injectors. As one example, the previously described fuel injectors may no longer sufficiently prevent soot production to a desired level in light of increasingly stringent emissions standards. As such, particulate filters may be located in an exhaust passage, thereby increasing a manufacturing cost and packaging restraint of the vehicle.

In one example, the issues described above may be addressed by a system comprising a fuel injector comprising an egg-shaped nozzle, wherein an opening is shaped to admit combustion chamber gases into a hollow interior of the egg-shaped nozzle forming an annular venturi passage between it and an outlet surface of the fuel injector. In this way, a compact mixer may promote air-fuel mixing prior to injecting the fuel into the combustion chamber.

As one example, the egg shaped nozzle comprises the opening to admit combustion chamber gases. The opening may be a first opening, wherein the egg-shaped nozzle further comprises at least one second opening for expelling the combustion chamber gases to the annular venturi passage. The annular venturi passage may receive fuel directly from a sac of the fuel injector, it may additionally receive fuel from one or more outlet passage extending through an injector body, wherein the outlet passage fluidly couple the sac to a constricted portion of the annular venturi passage. By doing this, the combustion chamber gases in the egg-shaped nozzle and the fuel from the outlet passage may promote a swirling effect in the annular venturi passage to further promote air-fuel mixing.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2A-4C are shown approximately to scale.

DETAILED DESCRIPTION

The following description relates to systems and methods for a fuel injector. The fuel injector may comprise a variety of air entraining features configured to mix air with fuel prior to combustion. The fuel injector inject fuel into a cylinder of a combustion engine, such as the combustion engine depicted in FIG. 1. The fuel injector may be a direct injector.

Figure 2B:
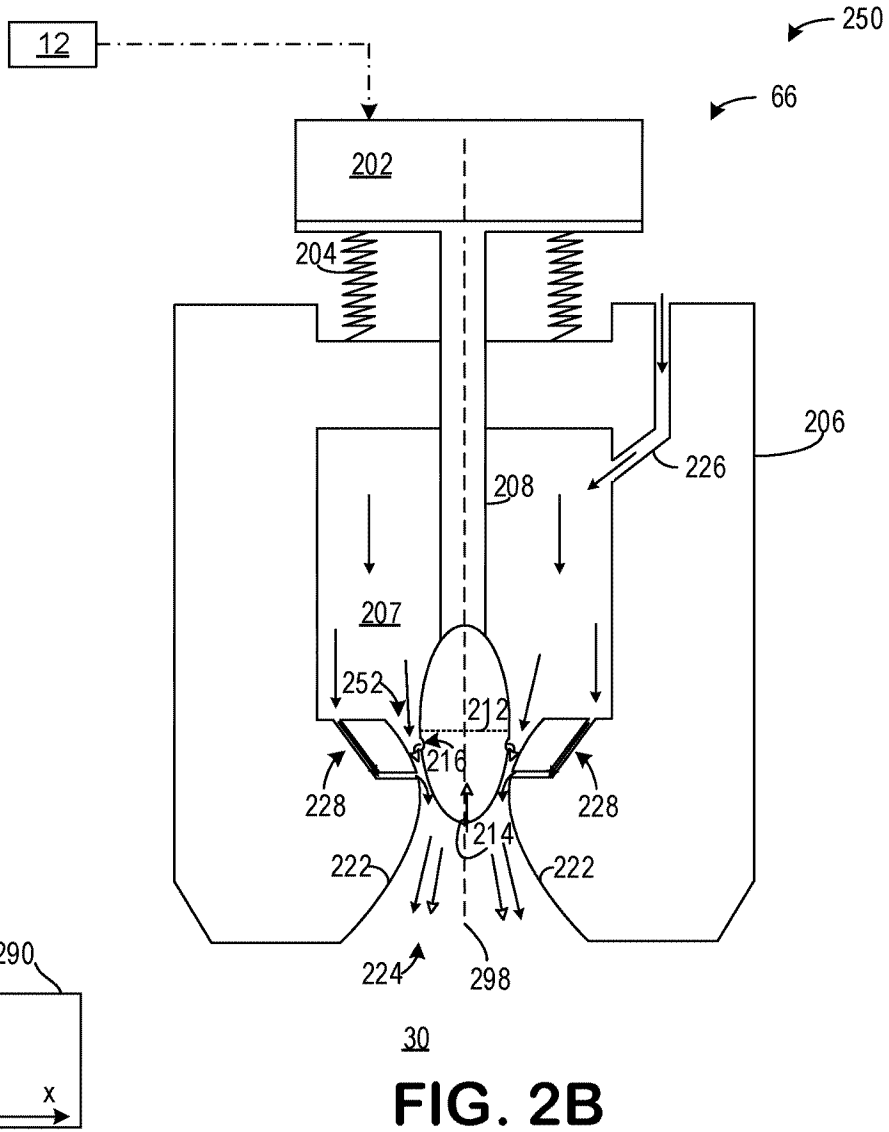
FIGS. 2A and 2B show a first embodiment of a nozzle a fuel injector in first and second positions, respectively.
Figure 2A:
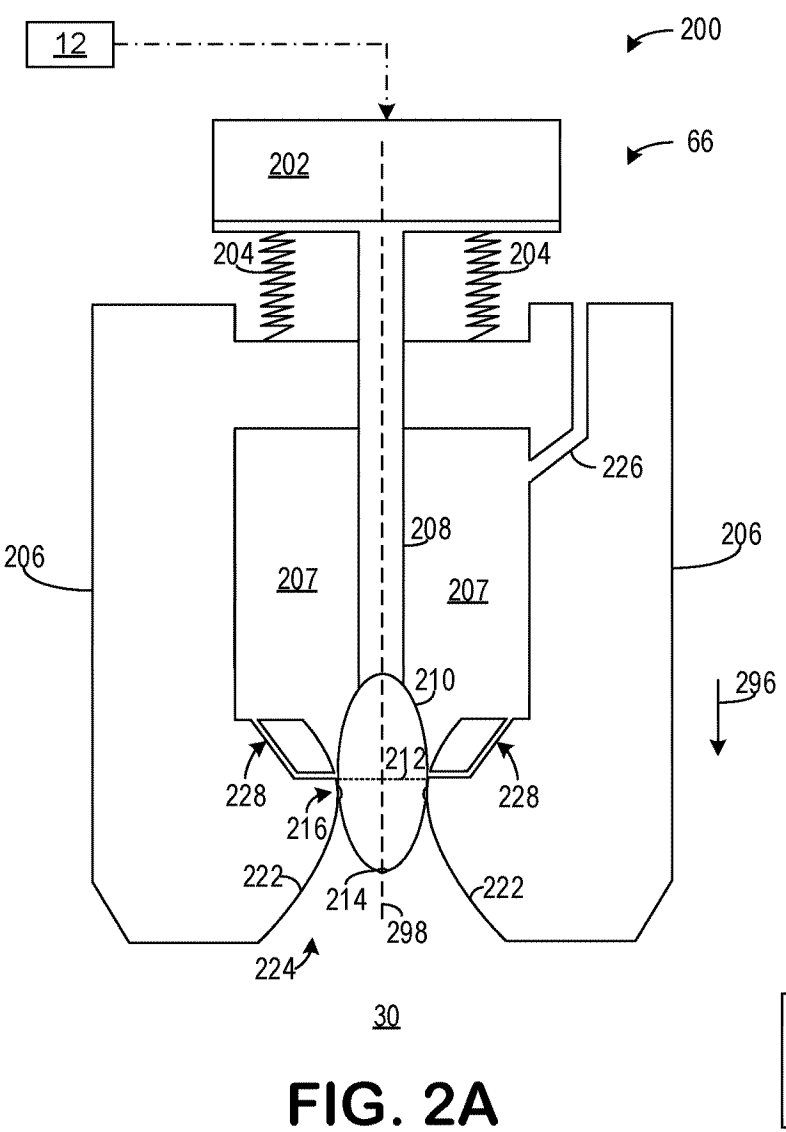

A first embodiment of the nozzle is shown in FIGS. 2A and 2B. Therein, the fuel injector comprises a substantially egg-shaped nozzle, wherein actuation of the egg-shaped nozzle may adjust one or more fuel injection settings. The egg-shaped nozzle may comprise a hollow interior and one or more openings for receiving air to mix with fuel before injecting the fuel into a volume of a combustion chamber.

Figure 3B:
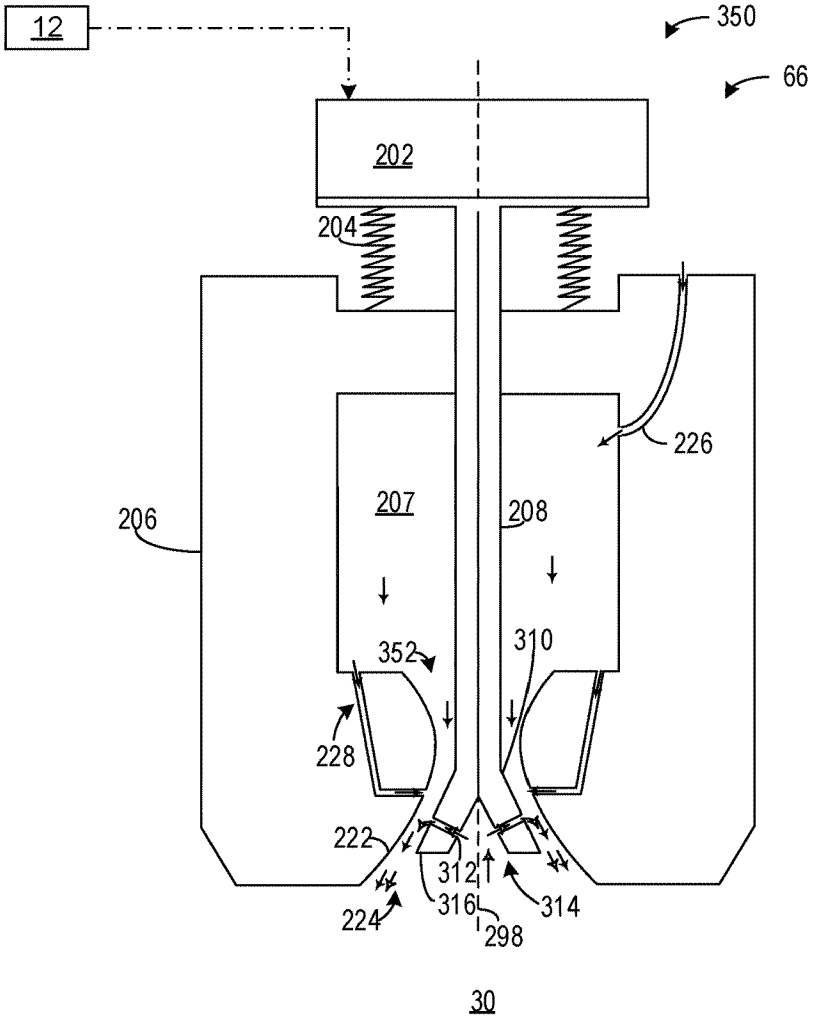
FIGS. 3A and 3B show a second embodiment of a nozzle of the fuel injector in first and second positions, respectively.
Figure 3A:
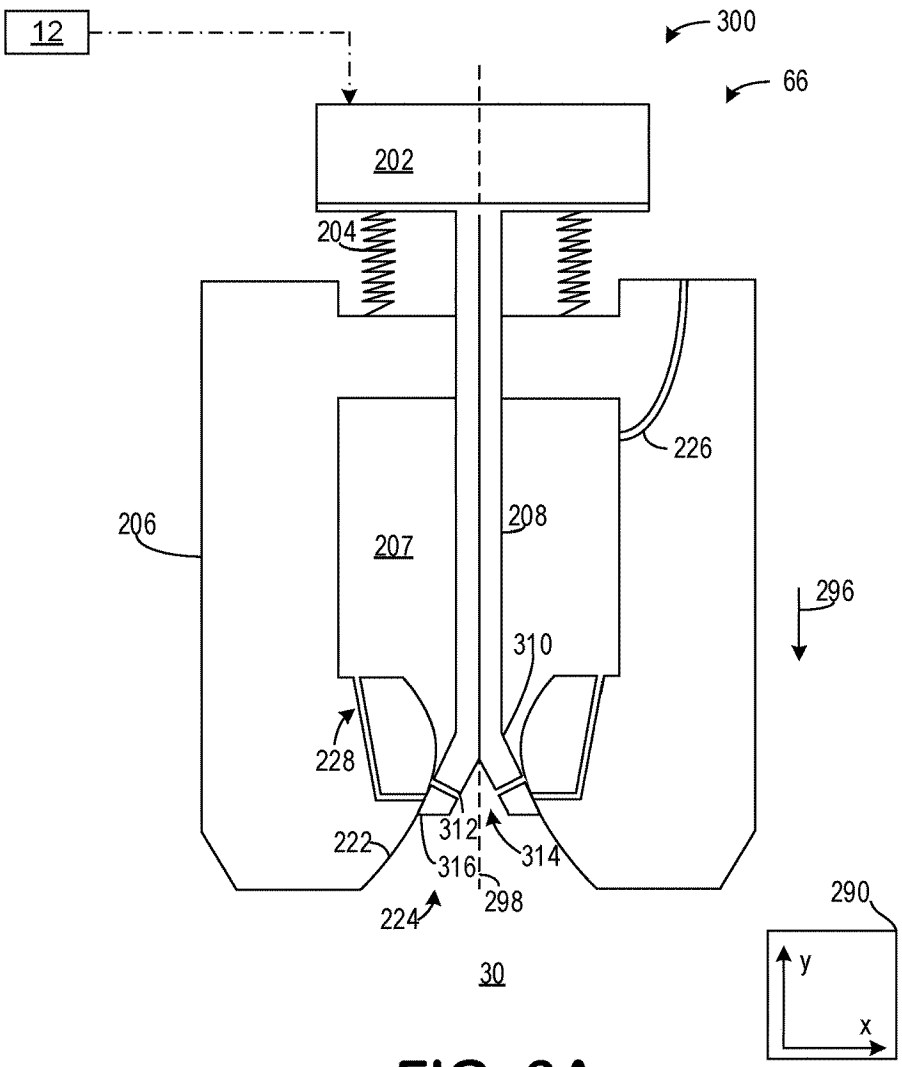

A second embodiment of the nozzle is shown in FIGS. 3A and 3B. Therein, the fuel injector comprises a cone-shaped nozzle, wherein actuation of the cone-shaped nozzle may adjust one or more fuel injection settings. The cone-shaped nozzle may comprise one or more passages for entraining air with fuel before injecting the fuel into a volume of the combustion chamber.

Figures 4A, 4B, 4C:
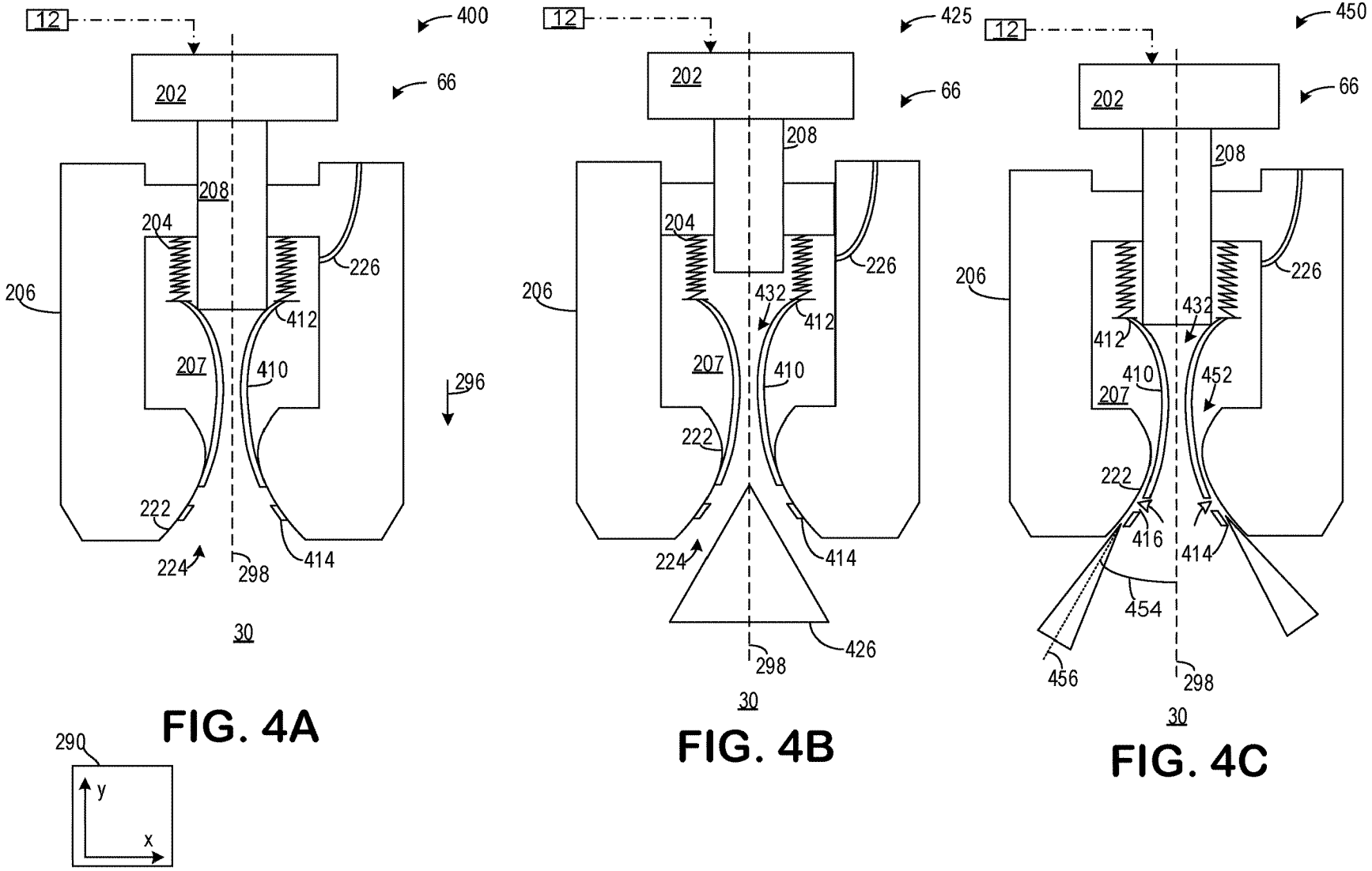
FIGS. 4A, 4B, and 4C show a third embodiment of a nozzle of the fuel injector in first, second, and third positions, respectively.
Figure 5:
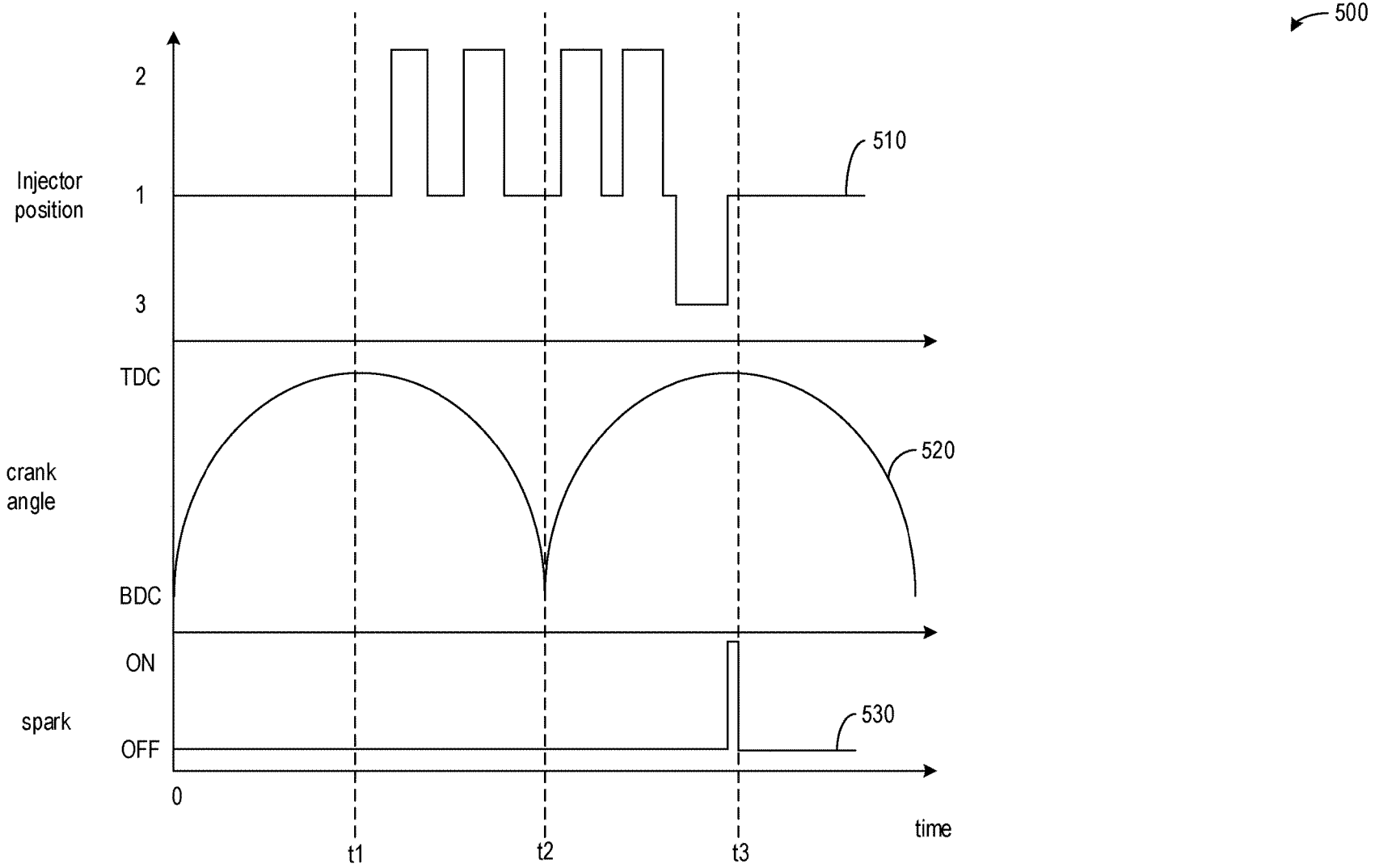
FIG. 5 shows an engine operating sequence illustrating an example injection routine of the fuel injector.

A third embodiment of the nozzle is shown in FIGS. 4A, 4B, and 4C. Therein, the fuel injector comprises an hourglass- and/or venturi-shaped nozzle, wherein actuation of the nozzle may adjust one or more fuel injection settings. These settings may include a fuel injection width and air entrainment. An engine operating sequence illustrating an injection pattern of the third embodiment is shown in FIG. 5.

FIGS. 1-4C show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Note that FIGS. 2B, 3B, 4B, and 4C show arrows indicating where there is space for gas to flow, and the solid lines of the device walls show where flow is blocked and communication is not possible due to the lack of fluidic communication created by the device walls spanning from one point to another. The walls create separation between regions, except for openings in the wall which allow for the described fluid communication.

Air in the combustion chambers may pass through the air passages and a more thorough and even mixing of the fuel and air may be achieved prior to combustion. In particular, the lift-off length, a term commonly used by those skilled in the art to describe the distance between the fuel spray and the combustion flame, may be increased. As such, more air may be entrained by the fuel prior to combustion. Thus, combustion may be delayed and air entrainment of the fuel may be increased, leading to a more complete and soot-free combustion.

Figure 1:
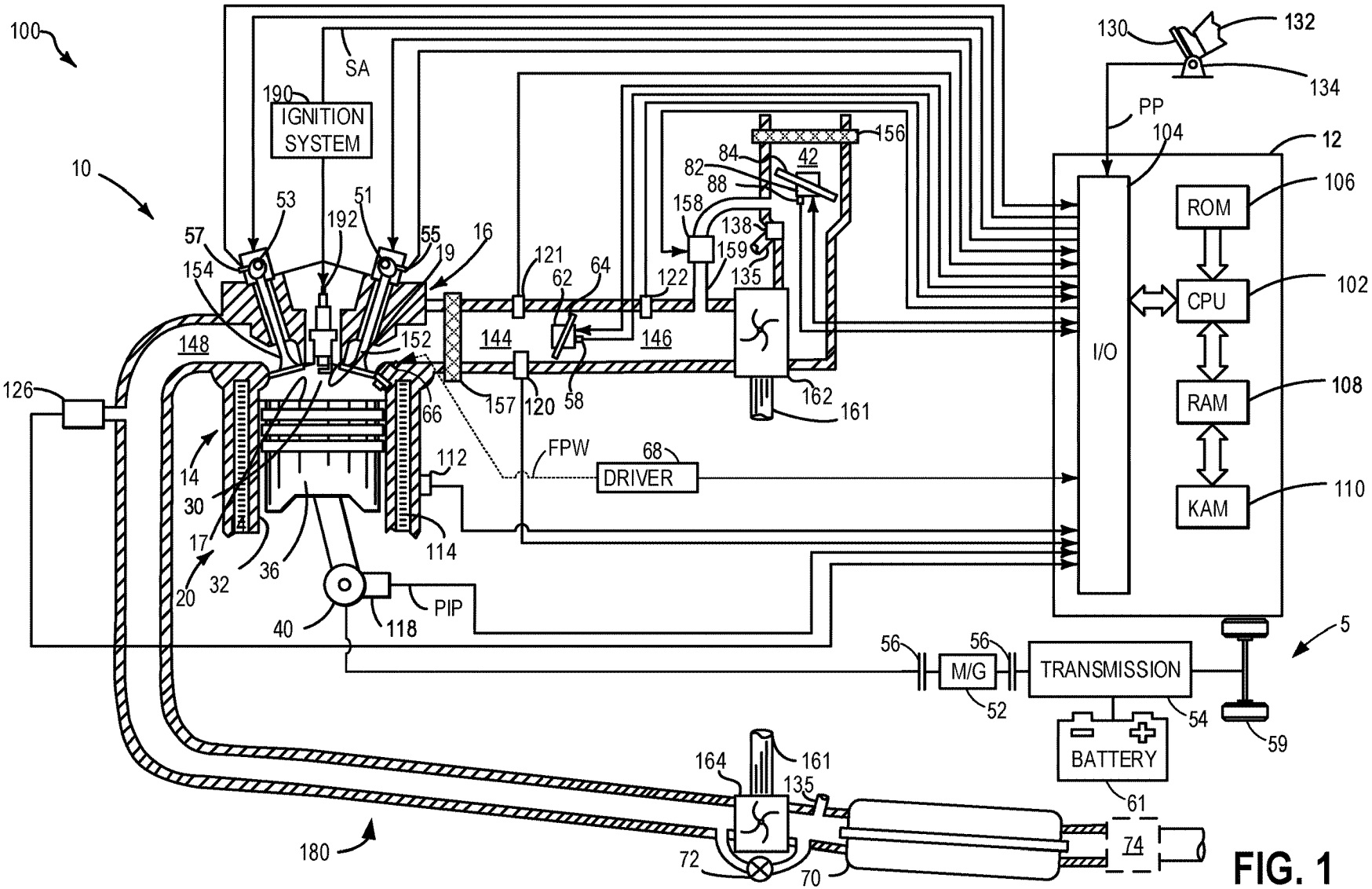
FIG. 1 shows an engine of a hybrid vehicle.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore 20, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. The cylinder bore 20 may be defined as the volume enclosed by the cylinder walls 32. The cylinder head 16 may be coupled to the cylinder block 14, to enclose the cylinder bore 20. Thus, when coupled together, the cylinder head 16 and cylinder block 14 may form one or more combustion chambers. In particular, combustion chamber 30 may be the volume included between a top surface 17 of the piston 36 and a fire deck 19 of the cylinder head 16. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore 20 may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such may the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

The cylinder walls 32, piston 36, and cylinder head 16 may thus form the combustion chamber 30, where a top surface 17 of the piston 36 serves as the bottom wall of the combustion chamber 30 while an opposed surface or fire deck 19 of the cylinder head 16 forms the top wall of the combustion chamber 30. Thus, the combustion chamber 30 may be the volume included within the top surface 17 of the piston 36, cylinder walls 32, and fire deck 19 of the cylinder head 16.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection 30. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

In some examples, the injector 66 may comprise one or more features to reduce the temperature of air that is entrained by the fuel injected from the injector 66. Specifically, when fuel exits the injector 66 during fuel injection, it may travel a distance while mixing with air in a nozzle before combusting. In the description herein, the distance the fuel spray travels before combusting may be referred to as the "lift-off length." In particular, the lift-off length may refer to the distance the injected fuel travels before the combustion process begins. Thus, the lift-off length may be a distance between an orifice of the injector 66 from which the fuel exits the injector 66, to a point in the combustion chamber 30 at which combustion of the fuel occurs.

The injector 66 may decrease the temperature of the gases that mix with the fuel prior to combustion in the combustion chamber 30. Furthermore, the injector 66 may enable a higher spray velocity, within and at a nozzle of the injector 66, thereby increasing air entrainment with the fuel injection and fuel penetration into the combustion chamber 30. In this way, the lift-off length of the fuel spray may be increased and/or an amount of air entrainment in the fuel spray may be increased. The nozzle may be in fluidic communication with combustion chamber 30, such that gases in the combustion chamber 30 may enter the one or more flow-through passages of the nozzle and be recirculated back into the combustion chamber 30. As one example, intake air introduced into the combustion chamber 30 during an intake stroke, may be pushed into the nozzle during all or a portion of the compression stroke.

Intake manifold 144 is shown communicating with optional electronic throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from downstream of charge air cooler 157 to the compressor inlet. In alternate examples, compressor recirculation path 159 may be configured to recirculate compressed air from downstream of the compressor and upstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Emission control device may be a catalytic converter and as such may also be referred to herein as catalytic converter 70. Alternatively, a two-state exhaust gas oxygen sensor may be substituted for UEGO sensor 126. Converter 70 may include multiple catalyst bricks, in one example. In another example, multiple emission control devices, each with multiple bricks, can be used. Converter 70 can be a three-way type catalyst in one example. While the depicted example shows UEGO sensor 126 upstream of turbine 164, it will be appreciated that in alternate embodiments, UEGO sensor may be positioned in the exhaust manifold downstream of turbine 164 and upstream of convertor 70. Additionally or alternatively, the converter 70 may comprise a diesel oxidation catalyst (DOC) and/or a diesel cold-start catalyst.

In some examples, a particulate filter (PF) 74 may be coupled downstream of the emission control device 70 to trap soot in a direction of exhaust gas flow. In some examples, there may exist a selective catalytic reduction device and/or a lean $NO_x$ trap between the converter 70 and the PF 74. The PF 74 may be manufactured from a variety of materials including cordierite, silicon carbide, and other high temperature oxide ceramics. The PF 74 may be periodically regenerated in order to reduce soot deposits in the filter that resist exhaust gas flow. Filter regeneration may be accomplished by heating the filter to a temperature that will burn soot particles at a faster rate than the deposition of new soot particles, for example, 400-600° C.

However, in other examples, due to the inclusion of flow-through passage(s) in a nozzle of the fuel injector 66, PF 74 may not be included in the engine 10. As such soot production during the combustion cycle may be reduced. In some examples, soot levels may be reduced to approximately zero due to the increased commingling of fuel and air prior to combustion/ignition of the mixture in the combustion chamber 30. As such, approximately no soot (e.g., zero soot) may be produced by engine 10 during the combustion cycle in some examples. In other examples, due to the features of the injector, soot production may be reduced and as such, the PF 74 may be regenerated less frequently, reducing fuel consumption.

During the combustion cycle, each cylinder within engine 10 may undergo a four stroke cycle including: an intake stroke, compression stroke, power stroke, and exhaust stroke. During the intake stroke and power stroke, the piston 36 moves away from the cylinder head 16 towards a bottom of the cylinder increasing the volume between the top of the piston 36 and the fire deck 19. The position at which piston 36 is near the bottom of the cylinder and at the end of its intake and/or power strokes (e.g., when combustion chamber 30 is at its largest volume) is typically referred to by those of skill in the art as bottom dead center (BDC). Conversely, during the compression and exhaust strokes, the piston 36 moves away from BDC towards a top of the cylinder (e.g., fire deck 19), thus decreasing the volume between the top of the piston 36 and the fire deck 19. The position at which piston 36 is near the top of the cylinder and at the end of its compression and/or exhaust strokes (e.g., when combustion chamber 30 is at its smallest volume) is typically referred to by those of skill in the art as top dead center (TDC). Thus, during the intake and power strokes, the piston 36 moves from TDC to BDC, and during the compression and exhaust strokes, the piston 36 moves from BDC to TDC.

Further, during the intake stroke, generally, the exhaust valves 154 close and the intake valves 152 open to admit intake air into the combustion chamber 30. During the compression stroke, both valves 152 and 154 may remain closed, as the piston 36 compresses the gas mixture admitted during the intake stroke. During the compression stroke, gases in the combustion chamber 30 may be pushed into the fuel injector 66 due to the positive pressure created by the piston 36 as it travels towards the injector 66. The gases from the combustion chamber 30 may dissipate heat through one or more of the cylinder head 16 and ambient air via conduction and/or convection. As such, the temperature of the gases in the injector 66 may be reduced relative to the temperature of the gases in the combustion chamber 30.

When the piston 36 is near or at TDC during the compression and/or power stroke, fuel is injected into the combustion chamber 30 by injector 66. During the ensuing power stroke, the valves 152 and 154 remain closed, as the expanding and combusting fuel and air mixture pushes the piston 36 towards BDC. In some examples, fuel may be injected prior to the piston 36 reaching TDC, during the compression stroke. However, in other examples, fuel may be injected when the piston 36 reaches TDC. In yet further examples, fuel may injected after the piston 36 reaches TDC and begins to translate back towards BDC during the power stroke. In yet further examples, fuel may be injected during both the compression and power strokes.

Fuel may be injected over a duration. An amount of fuel injected and/or the duration over which fuel is injected may be varied via pulse width modulation (PWM) according to one or more linear or non-linear equations. Further, the injector 66 may include a plurality of injection orifices, and an amount of fuel injected out of each orifice may be varied as desired.

The injected fuel travels through a volume of the nozzle of the injector 66 before entering the combustion chamber 30. Said another way, the nozzle may include air passages and fuel passages for entraining air and fuel, wherein the passages are located inside the combustion chamber 30. However, the passages are defined by surfaces of the nozzle and fuel injector body and fuel and air flow through these passages before flowing outside of the nozzle and into the combustion chamber 30 to mix with unmixed combustion chamber gases. The flow of air and fuel through the nozzle will be described in greater detail below.

During the exhaust stroke, the exhaust valves 154 may open to release the combusted air-fuel mixture to exhaust manifold 148 and the piston 36 returns to TDC. Exhaust gases may continue to flow from the exhaust manifold 148, to the turbine 164 via exhaust passage 180.

Both the exhaust valves 154 and the intake valves 152 may be adjusted between respective closed first positions and open second positions. Further, the position of the valves 154 and 152 may be adjusted to any position between their respective first and second positions. In the closed first position of the intake valves 152, air and/or an air/fuel mixture does not flow between the intake manifold 144 and the combustion chamber 30. In the open second position of the intake valves 152, air and/or an air/fuel mixture flows between the intake manifold 144 and the combustion chamber 30. In the closed second position of the exhaust valves 154, air and/or an air fuel mixture does not flow between the combustion chamber 30 and the exhaust manifold 148. However, when the exhaust valves 154 is in the open second position, air and/or an air fuel mixture may flow between the combustion chamber 30 and the exhaust manifold 148.

Note that the above valve opening and closing schedule is described merely as an example, and that intake and exhaust valve opening and/or closing timings may vary, such as to provide positive or negative valve overlap, late intake valve closing, or various other examples.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 61. Electric machine 61 may be a motor or a motor/generator. Crankshaft 40 of engine 10 and electric machine 61 are connected via a transmission 54 to vehicle wheels 59 when one or more clutches 56 are engaged. In the depicted example, a first clutch 56 is provided between crankshaft 40 and electric machine 61, and a second clutch 56 is provided between electric machine 61 and transmission 54. Controller 12 may send a signal to an actuator of each clutch 56 to engage or disengage the clutch, so as to connect or disconnect crankshaft 40 from electric machine 61 and the components connected thereto, and/or connect or disconnect electric machine 61 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 61 receives electrical power from a traction battery 58 to provide torque to vehicle wheels 59. Electric machine 61 may also be operated as a generator to provide electrical power to charge battery 58, for example during a braking operation.

The controller 12 receives signals from the various sensors of FIG. 1 and employs the various actuators of FIG. 1 to adjust engine operation based on the received signals and instructions stored on a memory of the controller. For example, adjusting a fuel injection may include adjusting an actuator of the injector 66 to move to or away from a nozzle of the injector 66 so that fuel may flow to the combustion chamber 30.

Turning now to FIG. 2A, it shows a first embodiment 200 of a nozzle 210 of the fuel injector 66. As such, components previously introduced may be similarly number in subsequent figures. The embodiment of FIG. 2A depicts a cross-section of the injector 66 and the nozzle 210 taken along a direction substantially parallel to a direction in which the injector 66 injects fuel (arrow 296). The injector 66 may comprise an actuator 202 configured to receive signals from the controller 12. The signals may dictate to the actuator 202 to actuate the nozzle 210 in response to a fuel injection demand. In the embodiment of FIG. 2A, the nozzle 210 is shown in a first position, wherein the first position corresponds to a closed position. Fuel may not flow from the injector 66 to the combustion chamber 30 when the nozzle 210 is in the first position. As such, a fuel injection may not occur when the nozzle 210 is in the first position.

An axis system 290 is shown comprising two axes, namely an x-axis perpendicular to a y-axis. The x-axis may be parallel to a horizontal direction and the y-axis may be parallel to a vertical direction. Alternatively, the x-axis may be parallel to the vertical direction and the y-axis may be parallel to the horizontal direction. A central axis 298 of the fuel injector 66 is shown. The central axis 298 is substantially parallel to the general direction of the fuel injection 296.

The nozzle 210 may be substantially egg-shaped. A cross-section along the central axis 298 of the nozzle 210 may be substantially elliptical as illustrated in the embodiment of FIG. 2A. However, cross-sections of the nozzle 210 along an axis perpendicular to the central axis 298 may be substantially circular. The circular cross-section may vary in diameter at different locations of the central axis 298. For example, a cross-section taken parallel to dashed line 212 may produce a circular cross-section of a largest diameter. Thus, other cross-sections of the nozzle 210 taken away from the dashed line 212 and perpendicular to the central axis 298 may be circular cross-section having smaller diameters.

The central axis 298 may pass through a geometric center of the nozzle 210. In one example, the central axis 298 is aligned with a largest height of the nozzle 210. The dashed line 212 may be aligned with a largest width of the nozzle 210 and may also pass through a geometric center of the nozzle 210. Thus, the central axis 298 and dashed line 212 may intersect at the geometric center of the nozzle 210. The central axis 298 may be arranged along a largest height of the nozzle 210 while the dashed line 212 may be arranged along a largest width of the nozzle 210. In one example, the central axis 298 is a first central axis of the nozzle 210 and the dashed line 212 is a second central axis of the nozzle, wherein the first central axis is parallel to a height of the nozzle and the second central axis is parallel to a width of the nozzle. The first and second central axes may be perpendicular to one another.

In some embodiments of the nozzle 210, the nozzle may comprise a spinning top shape, eggplant shape, or other shape. In this way, the central axis 298 and the dashed line 212 may not intersect at the geometric center of the nozzle 210. For example, if the nozzle is eggplant shaped, then the central axis 298 and the dashed line 212 may intersect at a point below the geometric center of the nozzle. That is to say, the largest width may not be arranged around the geometric center of the nozzle 210.

The nozzle 210 may be substantially hollow and comprise one or more perforations arranged in its outer shell. More specifically, the nozzle 210 may comprise at least one first perforation 214 and at least one second perforation 216. The first perforation 214 may be arranged at an extreme end of the nozzle 210 facing the combustion chamber 30. The first perforation 214 may be substantially circular and arranged such that the central axis 298 passes through its geometric center. In some examples, the first perforation 214 may be a single perforation. In other examples, the first perforation 214 may be one perforation of a plurality of perforations arranged at the extreme end of the nozzle 210. The second perforation 216 may be substantially identical to the first perforation in size and shape. In some examples, additionally or alternatively, the second perforation 216 may be smaller than the first perforation 214. The second perforation 216 may be arranged between the first perforation 214 and the dashed line 212. Said another way, the second perforation 216 may be arranged between a largest width of the nozzle 216 and the first perforation 214. The second perforation 216 may be a single perforation of a plurality of perforations. In one example, there are exactly four of the second perforation 216, wherein each iteration of the second perforation 216 is spaced 90° relative to adjacent second perforations. Additionally or alternatively, there may be three or fewer of the second perforation 216. Additionally or alternatively, there may be five or more of the second perforation 216.

The first perforation 214 and the second perforation 216 may fluidly couple a hollow interior space of the nozzle 210 to an external environment (e.g., the combustion cylinder 30). In some examples, air from the combustion cylinder 30 may flow into the interior space of the nozzle 210 via the first perforation 214, and out of the interior space via the second perforation 216. This will be described in greater detail in FIG. 2B.

The nozzle 210 may be electrically, pneumatically, hydraulically, and/or mechanically actuated via the actuator 202. A rod 208 may be physically coupled to the actuator 202 at a first end and physically coupled to the nozzle 210 at a second end. The rod 208 may be t-shaped. The rod 208 and the nozzle 210 may be a single, contiguous piece. The rod 208 may be configured to actuate between surfaces of the injector body 206 such that a volume of a sac 207 may be adjusted. In some examples, the rod 208 may slide, twist, rotate, and/or spin within the injector body 206. In one example, the rod 208 is slidably arranged within the fuel injector body 206, wherein the rod is physically coupled to the nozzle 210 via one or more of welds, fusions, adhesives, fasteners, and the like.

More specifically, in response to an absence of force from the actuator 202, which may be a result of a fuel injection demand being absent, springs 204 may force the nozzle 210 into the first position. The springs 204 may press against the rod 208 such that the nozzle 210 is actuated toward the combustion chamber 30 parallel to the central axis 298. In some examples, the central axis 298 may be parallel to a vertical direction if the injector 66 is coupled to a fire deck (e.g., fire deck 19 of FIG. 1). Additionally or alternatively, the central axis may be parallel to a horizontal direction if the injector 66 is coupled to a combustion chamber surface in a cylinder block (e.g., cylinder block 14 of FIG. 1).

Pressing the nozzle 210 into the first position may further include pressing surfaces of the nozzle 210 against at least one surface of the injector body 206. More specifically, surfaces of the nozzle 210 corresponding to the largest width of the nozzle, marked by dashed line 212, may contact surfaces of the injector body 206. More specifically, the nozzle 210 may contact an outlet surface 222 of the injector body 206. The outlet surface 222 may be concave relative to and concentric with the central axis 298. Thus, the outlet surface 222 may obstruct at least a portion of an outlet 224 of the injector 66.

A feed passage 226 may be arranged in a portion of the injector body 206 above the nozzle 210 relative to the y-axis. The feed passage 226 may be configured to direct fuel from a fuel chamber to the sac 207. In one example, the fuel chamber is a high-pressure fuel pump.

A plurality of interior passages 228 may be arranged below the feed passage 226 relative to the y-axis. The interior passages 228 may fluidly couple the sac 207 to a portion of the outlet 224 between the outlet surface 222. In the first position, the interior passages 228 may be sealed from the outlet 224 due to a position of the nozzle 210. Additionally, air from the interior space of the nozzle 210 may not communicate with fuel in the interior passages 228. A contact point, which may include a point where the nozzle 210 and the outlet surface 222 touch, may be arranged between the interior passages 228 and the second perforation 216. The contact point may correspond to a greatest width of the nozzle 210, indicated by dashed line 212, and a portion of the outlet surface 222 downstream of the interior passages 228 relative to the general direction of a fuel injection 296. In this way, the sac 207 may be hermetically sealed from the combustion chamber 30 when the nozzle 210 is in the first position.

A number of interior passages 228 may be substantially equal to a number of second perforations 216. In one example, there are exactly four of each of the interior passages 228 and the second perforations 216. Additionally or alternatively, the number of interior passages 228 may be less than or greater than a number of second perforations 216.

Turning now to FIG. 2B, it shows an embodiment 250, substantially identical to the first embodiment 200, except that the embodiment 250 illustrates the nozzle 210 in a second position. The second position may include a position of the nozzle 210 wherein the nozzle 210 is moved away from the outlet surface 222 and combustion chamber 30. More specifically, the controller 12 may send a signal to the actuator 202 to move the nozzle 210 away from the outlet surface 222 in an upstream direction relative to the general fuel injection direction 296. Moving the nozzle 210 to the second position may further comprise overcoming a force of the springs 204. By doing this, fuel may flow into the combustion cylinder 30. It will be appreciated that the nozzle 210 may be actuated to positions between the first position and the second position.

As shown, when in the second position, the second perforations 216 may be arranged above the interior passages 228. This may allow gases ejected via the second perforations 216 to mix with fuel for a greater duration of time before reaching the combustion chamber 30.

Furthermore, the second position may further includes where the springs 204 are elongated relative to the springs 204 in the first position of FIG. 2A. As described above, the actuator 202 is deactivated during the first position, such that the springs 204 may actuate to a compressed position in the absence of a force being applied thereto. In the second position, the actuator 202 may pull against the rod 208 such that the nozzle 210 is drawn into the sac 207. The volume of the sac 207 may decrease while its pressure increases to promote fuel flow to the combustion chamber 30. By drawing up the nozzle 210, the springs 204 may actuate to an elongated position, as shown in FIG. 2B.

Black head arrows depict a direction of fuel flow and white head arrows depict a direction of gas (e.g., air) flow. Fuel may flow from the sac 207 to the combustion cylinder 30 via outlet passage 252 which may form between the nozzle 210 and the outlet surface 222. The outlet passage 252 may comprise an annular venturi shape, such that a venturi inlet, venturi outlet, and venturi throat are formed.

The venturi throat may be arranged between the venturi inlet and venturi outlet of the outlet passage 252, wherein the venturi throat corresponds to a more constricted region of the interior passage. The venturi inlet of the outlet passage 252 may allow fuel to flow therein. As the fuel flows through the venturi throat and into the venturi outlet of the outlet passage 252, a vacuum may form at the venturi throat, wherein the vacuum may promote one or more of fuel flow through the interior passages 228 and air flow through the nozzle 210. Thus, combustion chamber gases (e.g., ambient air, compressed air, EGR, and the like) may flow into the nozzle 210 via the first perforation 214. The gases may flow out of the nozzle 210 via one or more of the second perforation 216, wherein the gases may mix with fuel before flowing to the combustion chamber 30. In this way, air from the nozzle 210 and fuel from the interior passages 228 may combine with fuel in the outlet passage 252 at the venturi throat of the outlet passage 252.

By flowing fuel through the interior passages 228 into the outlet passage 252, a swirl may be induced. The swirl may be clockwise or counterclockwise relative to the central axis 298. The swirl may promote fuel atomization and air entrainment. Air flowing out of one or more of the second perforation 216 may further promote the swirl. The air may be increasingly mixed with the fuel prior to reaching the combustion chamber 30. By doing this, soot emissions may decrease.

In some examples, by adjusting the nozzle 210 between the first and second positions, one or more fuel injection settings may be adjusted. For example, if the nozzle 210 is between the first and second positions, a fuel injection pressure and/or fuel injection angle may be adjusted. As an example, if the nozzle 210 is moved from the second position to a position between the first and second position, a fuel injection pressure may decrease and a fuel injection angle may increase, wherein the fuel injection angle is measured from a center of the fuel injection to the central axis 298.

Turning now to FIG. 3A, it shows a second embodiment 300 of the fuel injector 66. The second embodiment 300 may be substantially similar to the first embodiment 200, except that the nozzle 310 and its air entraining features are different. More specifically, the nozzle 310 may comprise a Y-shaped cross-section as shown. The nozzle 310 may be cone-shaped in three-dimensions (e.g., the third dimension include a z-axis perpendicular to each of the x- and y-axes of the axis system 290). Additionally or alternatively, the nozzle 310 may be pyramid-shaped, trapezoid-prism shaped, and/or the like. The nozzle 310 may comprise an indentation 314 extending through a bottom of the nozzle. The indentation 314 may be shaped similarly to the nozzle 310. Thus, in the present embodiment of FIG. 3A, the indentation 314 is cone-shaped and comprises a triangular cross-section, as shown. The indentation 314 may be configured to receive one or more combustion chamber 30 gases, wherein the gases may be directed to one or more air entraining passages 312. The nozzle 310 and the rod 208 may be a single, contiguous piece.

The nozzle 310 is shown in a first position, wherein surfaces of the nozzle 310 are pressed against the outlet surface 222 of the injector body 206. More specifically, an extreme end 316 of the nozzle 310 may correspond to a largest diameter of the nozzle 310. The nozzle 310 may contact the outlet surface 222 at a portion of the nozzle 310 between the air entraining passages 312 and the extreme end 316. The injector 66 may not inject fuel to the combustion chamber 30 when the nozzle is in the first position. Thus, the sac 207 and interior passages 228 are fluidly sealed from the combustion chamber 30.

Turning now to FIG. 3B, it shows an embodiment 350, substantially similar to the embodiment 300, except that the embodiment 350 illustrates the nozzle 310 in a second position where a fuel injection from the injector 66 into the combustion cylinder 30 may occur. More specifically, the second position may correspond to a most open position of the fuel injector 66 such that the second position may allow a highest volume fuel injection into the combustion cylinder 30. In some examples, the nozzle 310 may be actuated to a position between the first position, shown in FIG. 3A, and the second position, shown in FIG. 3B. In this way, an amount of fuel being injected may be adjusted.

In the second position, the controller 12 signals to the actuator 202 to overcome a force of the springs 204 and actuate the nozzle 310 away from the outlet surface 222. An outlet passage 352 may form and fluidly couple the sac 207 to the combustion chamber 30. Fuel flow from the sac 207 to the combustion chamber 30 is illustrated via black head arrows.

Specifically, the springs 204 may be relatively elongated in the first position shown in FIG. 3A. That is to say, in the absence of force being applied by the actuator 202, the springs 204 may extend to an elongated position. When the actuator 202 presses against the rod 208 and actuates the nozzle 310 toward the combustion chamber 30, away from the sac 207, the springs 204 may compress to a compressed position corresponding to the second position.

The outlet passage 352 may be shaped similarly to the outlet passage 252 of FIG. 2B. In this way, the outlet passage 352 may comprise an annular venturi shape having a venturi inlet, venturi outlet, and venturi throat arranged therebetween. The venturi throat corresponding to an area of greatest restriction in the outlet passage 352. Thus, the outlet passage 352 may be an annular venturi passage.

Gas from the combustion chamber 30, shown by white head arrows, may flow through the indentation 314 and into the air entraining passages 312. The flow of gas may be promoted via a vacuum generated by a Venturi effect generated between the outlet surface 222 and the nozzle 310 in the outlet passage 352. The vacuum may promote gas flow from the air entraining passages 312 to the outlet passage 352 so that combustion chamber gases and fuel may mix before flowing through the outlet 224 and into the combustion chamber 30.

The flow of fuel and air from the interior passages 228 and the air entraining passages 312, respectively, may promote a swirl in the outlet passage 352. By doing this, the fuel flowing into the combustion chamber 30 may comprise a more homogenous mixture of air and fuel than an injection provided by an injector without air entraining features or features to promote a swirl.

Turning now to FIG. 4A, it shows a third embodiment 400 of the fuel injector 66 comprising a nozzle 410. The third embodiment 400 may be substantially identical to the first embodiment 200 and the second embodiment 300, except that the third embodiment comprises the nozzle 410, which may be differently shaped than the nozzle 210 and the nozzle 310, respectively.

The nozzle 410 may comprise a venturi shape. In the cross-section depicted, the nozzle 410 comprises an hourglass and/or a venturi shape. That is to say, the nozzle 410 may comprise a constriction along a central portion such that the nozzle 410 is wider at upstream 312 and downstream 314 extreme ends. The upstream and downstream extreme ends may be relative to a direction of fuel flow such that the upstream extreme end 312 is nearer to the springs 204 and the downstream extreme end 314 is nearer to the outlet 224. The upstream extreme end 312 may be physically coupled to the springs 204, which are configured to press the downstream extreme end against outlet surface 222 in the absence of a force being applied by the actuator 202 to the rod 208.

The rod 202 may be actuated in a direction parallel to the general direction of the fuel injection 296, or in a direction opposite to the general direction of the fuel injection 296, as shown by FIGS. 4C and 4B, respectively. In FIG. 4B, an embodiment 425 shows a second position of the injector 66. The central axis 298 passes through a center of the injection 426 such that an angle generated between a center of the injection and the central axis 298 is substantially zero. The injection 426 may be directed through a central passage 432 of the nozzle 410.

The central passage 432 may be substantially venturi-shaped and/or hourglass shaped, extending from the upstream extreme end 412 to the downstream extreme end 414. By actuating the rod 208 in an upward direction, the sealing contact between the rod and the nozzle 410 may be disrupted such that fuel may flow from the sac 207, through the central passage 432, and into the combustion chamber 30. Air entraining features 416 of the nozzle 410 may not influence the injection 426. That is to say, the air entraining features 416 may not increase air mixing with the fuel injection 426 prior to the injection reaching the combustion chamber 30. As such, the nozzle 410 may remain in contact with the outlet surface 222 of the injector body 206 when the injector 66 is in the second position.

Turning now to FIG. 4C, it shows an embodiment 450 of the fuel injector 66 being in a third position. As shown, the actuator 202 may actuate the rod 208 in a direction toward the nozzle 410. The controller 12 may signal to the actuator 202 to overcome a power of the springs 204, such that the nozzle 410 is moved in a direction parallel to the general fuel injection direction 296 toward the combustion chamber 30. In this way, the nozzle 410 may move toward the combustion chamber 30 and its downstream extreme end 414 may be spaced away from outlet surface 222 of the injector body 206.

In the third position, the central passage 432 may be sealed near the upstream extreme end 412 such that fuel may not flow therethrough. As a result, fuel may flow through only the outlet passage 452 formed between the outlet surface 222 and the nozzle 410. The air entraining features 416 may promote air mixing with the injection prior to the injection reaching the combustion chamber 30. In some examples, the outlet passage 452 may form a venturi shape such that a vacuum of the outlet passage 452 may draw combustion chamber gases through the air entraining features 416 and into the outlet passage. Thus, fuel may not flow through the air entraining features 416.

The outlet passage 452 may be an annular venturi passage, similar to the outlet passages 252 and 352 of FIGS. 2B and 3B, respectively. The air entraining features 416 may flow air (shown by white head arrows) into the outlet passage 452 such that a swirl is generated.

An angle 454 of the injection may be measured between a central axis 456 of the injection and the central axis 298. The angle 454 may be between 10 to 80 degrees. Additionally or alternatively, in some embodiments, the angle 454 may be between 20-70 degrees. Additionally or alternatively, in some embodiments, the angle 454 may be between 30-60 degrees. In one example, the angle 454 is exactly 60 degrees.

In some examples, the injector 66 comprising the nozzle 410 may be actuated between each of the first, second, and third positions during a single combustion cycle of a cylinder. This is illustrated in FIG. 5.

Turning now to FIG. 5, it shows an engine operating sequence 500 illustrating an operation of the fuel injector 66 of FIGS. 1 through 4C. In one example, the engine operating sequence illustrates an operation of the fuel injector 66 comprising the nozzle 410 of FIGS. 4A, 4B, and 4C. Plot 510 illustrates a position of the injector, plot 520 illustrates a crank angle, and plot 530 illustrates spark. Injector position 1 may correspond to a first injector position, where no fuel is injection occurring, as illustrated in FIG. 4A. Injector position 2 may correspond to the second injector position illustrated in FIG. 4B, where an injection flows through a central passage of a nozzle. Injector position 3 may correspond to the third injector position illustrated in FIG. 4C, where an injection flows through the outlet passages formed between the nozzle and the outlet surface of the injector body. Time increases from a left to right side of the figure.

Prior to t1, the crank angle (plot 520) changes from BDC to TDC as an exhaust stroke is executed. During the exhaust stroke, the injector position may remain at 1 (plot 520) where an injection may not occur. Additionally, spark may be off (plot 530).

At t1, the crank angle reaches TDC, which may indicate the termination of the exhaust stroke and initiation of the intake stroke. After t1 and prior to t2, the intake stroke may continue. During the intake stroke, the injector position may be adjusted to the second position, where the fuel injection may occur through the central passage of the nozzle. Thus, an angle of the fuel injection may be substantially zero relative to a central axis of the fuel injector. In this way, no portion of the fuel injection may be directed toward a spark plug.

During the intake stroke, the injector position may oscillate between the first and second positions after an intake valve opening. That is to say, the injector position may not switch from the first position to the second position until the intake valve has opened and ambient air and/or boost air is permitted to enter the combustion chamber. In one example, the injector is adjusted from the first position to the second position exactly twice during the intake stroke such that two fuel injections occur. A first duration may be substantially equal to a time lapse between the two injections. The intake valve may close following the second injection.

At t2, the crank angle reaches BDC, which may indicate the termination of the intake stroke and initiation of the compression stroke. As such, the piston may move to compress a contents of the combustion chamber. After t2 and prior to t3, the crank angle may continue to increase. During the compression stroke, the injector position may be adjusted twice from the first position to the second position, similar to the intake stroke. However, a second duration, which may be substantially equal to a time lapse between the two injections in the second position during the compression stroke, may be less than the first duration. Thus, the injections during the compression stroke may occur in quicker succession than the injections during the intake stroke. Following the last of the injections in the second position, the injector position may be shifted from the second position, to the first position, and to the third position. By injecting in the third position, an angle of the injection may be between 10-80 degrees relative to the central axis of the injector. This may direct at least a portion of the injection toward a spark plug. Following completion of the injection in the third position, which may be near a TDC crank angle, the spark may be activated. By directing a portion of the fuel injection toward the spark plug before its activation, combustion may be more complete. For example, a combustion stability may increase due to fuel being adjacent the spark plug prior to its activation. In this way, emissions may decrease compared to an injector only injecting in a second position.

At t3, the crank angle is at TDC, which may indicate the termination of the compression stroke and initiation of the combustion stroke. After t3, the combustion stroke may continue. The spark may remain off and the injector position may remain in the first position where an injection does not occur.

In this way, an injector may comprise a nozzle having air entraining features that may increase air mixing with a fuel injection prior to injecting the fuel into a combustion cylinder. The injector may be further configured to adjust one or more of the nozzle or an actuator to adjust an injection angle of the fuel injection. The technical effect of the injector having air entraining features while being configured to adjust an injection angle is to increase combustion stability, increase fuel/air homogenization, and decrease emissions. By doing this, fuel economy may increase and maintenance of emission control devices may be reduced.

A system comprises a fuel injector comprising an egg-shaped nozzle, wherein an opening is configured to admit combustion chamber gases into a hollow interior of the egg-shaped nozzle, the egg-shaped nozzle configured to form an annular venturi passage between it and an outlet surface of the fuel injector. A first example of the system further includes where the hollow interior expels combustion chamber gases to the outlet passage. A second example of the system, optionally including the first example, further includes where the opening is a first opening arranged along a central axis of the egg-shaped nozzle, further comprising a plurality of second openings configured to expel combustion chamber gases in the hollow interior, wherein the central axis is aligned with a greatest height of the egg-shaped nozzle. A third example of the system, optionally including the first and/or second examples, further includes where a size of the first opening is equal to a combined size of each of the plurality of second openings. A fourth example of the system, optionally including one or more of the first through third examples, further includes where the plurality of second openings are arranged below a largest width of the egg-shaped nozzle, and where the largest width of the egg-shaped nozzle corresponds to a portion of the egg-shaped nozzle configured to press against the outlet surface of a fuel injector body. A fifth example of the system, optionally including one or more of the first through fourth examples, further includes where the egg-shaped nozzle is pressed against the outlet surface of a fuel injector body when in a first position, and where the egg-shaped nozzle is spaced away from the outlet surface of the fuel injector body to form the annular venturi passage when in a second position. A sixth example of the system, optionally including one or more of the first through fifth examples, further includes where the fuel injector does not inject fuel into a combustion chamber when the fuel injector body is in the first position, and where the fuel injector injects fuel into the combustion chamber via the annular venturi passage when the egg-shaped nozzle is in the second position. A seventh example of the system, optionally including one or more of the first through sixth examples, further includes where the egg-shaped nozzle moves away from the combustion chamber when moving from the first position to the second position.

A method comprises adjusting a fuel injection angle of a fuel injector via adjusting an interface between a rod coupled to an actuator and a venturi-shaped nozzle, wherein the fuel injection angle is decreased via actuating the rod away from the venturi-shaped nozzle. A first example of the method further includes where the fuel injection angle is increased via actuating the rod toward the venturi-shaped nozzle, the rod pressing the venturi shaped nozzle toward a combustion chamber. A second example of the method, optionally including the first example, further includes where the fuel injection angle is decreased during an intake stroke. A third example of the method, optionally including the first and/or second examples, further includes where the fuel injection angle is increased exactly before a spark plug is activated, wherein the spark plug is activated before a termination of a compression stroke. A fourth example of the method, optionally including one or more of the first through third examples, further includes where the fuel injector performs five fuel injections prior to the spark plug being activated, and where four of the fuel injections comprises a decreased fuel injection angle. A fifth example of the method, optionally including one or more of the first through fourth examples, further includes where the fuel injection angle is measured between a central axis of the fuel injector and a central axis of a fuel injection. A sixth example of the method, optionally including one or more of the first through fifth examples, further includes where the venturi-shaped nozzle comprises a venturi passage extending along a central axis of the fuel injector, and where the venturi-shaped nozzle forms an annular venturi passage when it is spaced away from an outlet surface of the fuel injector.

A system comprises an engine having at least one combustion chamber, a fuel injector positioned to inject into the at least one combustion chamber, the fuel injector comprising an egg-shaped nozzle having a one or more openings fluidly coupling a hollow interior of the egg-shaped nozzle to the at least one combustion chamber, and a controller with computer readable-instructions stored on non-transitory memory thereof that when executed enable the controller to press the egg-shaped nozzle against an outlet surface of the fuel injector in a first position and move the egg-shaped nozzle away from the outlet surface of the fuel injector in a second position. A first example of the system, further includes where the second position further comprising an outlet passage forming between the egg-shaped nozzle and the outlet surface, wherein the outlet passage comprises an annular venturi shape. A second example of the system, optionally including the first example, further includes where a plurality of passages extend from a sac of the fuel injector to the outlet passage, and where the one or more openings of the egg-shaped nozzle comprises a first opening and a plurality of second openings, and where the plurality of second openings are closer to the combustion chamber in the first position than outlets of the plurality of passages, and where the plurality of second openings are farther from the combustion chamber in the second position than the outlets of the plurality of passages. A third example of the system, optionally including the first and/or second examples, further includes where the one or more openings comprise a first opening aligned with a central axis of the fuel injector, further comprising a plurality of second openings radially spaced away from the central axis of the fuel injector. A fourth example of the system, optionally including the first through third examples, further includes where the first opening is configured to only admit gases into the hollow interior, and where the plurality of second openings are configured to only expel gases from the hollow interior.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a fuel injector comprising an egg-shaped nozzle, wherein an opening is shaped to admit combustion chamber gases into a hollow interior of the egg-shaped nozzle forming an annular venturi passage between it and an outlet surface of the fuel injector.

2. The system of claim 1, wherein the hollow interior expels combustion chamber gases to the outlet passage.

3. The system of claim 1, wherein the opening is a first opening arranged along a central axis of the egg-shaped nozzle, further comprising a plurality of second openings configured to expel combustion chamber gases in the hollow interior, wherein the central axis is aligned with a greatest height of the egg-shaped nozzle.

4. The system of claim 3, wherein a size of the first opening is equal to a combined size of each of the plurality of second openings.

5. The system of claim 3, wherein the plurality of second openings are arranged below a largest width of the egg-shaped nozzle, and where the largest width of the egg-shaped nozzle corresponds to a portion of the egg-shaped nozzle configured to press against the outlet surface of a fuel injector body.

6. The system of claim 1, wherein the egg-shaped nozzle is pressed against the outlet surface of a fuel injector body when in a first position, and where the egg-shaped nozzle is spaced away from the outlet surface of the fuel injector body to form the annular venturi passage when in a second position.

7. The system of claim 6, wherein the fuel injector does not inject fuel into a combustion chamber when the fuel injector body is in the first position, and where the fuel injector injects fuel into the combustion chamber via the annular venturi passage when the egg-shaped nozzle is in the second position.

8. The system of claim 6, wherein the egg-shaped nozzle moves away from the combustion chamber when moving from the first position to the second position.

9. A method, comprising:

adjusting a fuel injection angle of a fuel injector via adjusting an interface between a rod coupled to an actuator and a venturi-shaped nozzle, the fuel injection angle decreased via actuating the rod away from the venturi-shaped nozzle.

10. The method of claim 9, wherein the fuel injection angle is increased via actuating the rod toward the venturi-shaped nozzle, the rod pressing the venturi shaped nozzle toward a combustion chamber.

11. The method of claim 9, wherein the fuel injection angle is decreased during an intake stroke.

12. The method of claim 9, wherein the fuel injection angle is increased exactly before a spark plug is activated, wherein the spark plug is activated before a termination of a compression stroke.

13. The method of claim 12, wherein the fuel injector performs five fuel injections prior to the spark plug being activated, and where four of the fuel injections comprises a decreased fuel injection angle.

14. The method of claim 9, wherein the fuel injection angle is measured between a central axis of the fuel injector and a central axis of a fuel injection.

15. The method of claim 9, wherein the venturi-shaped nozzle comprises a venturi passage extending along a central axis of the fuel injector, and where the venturi-shaped nozzle forms an annular venturi passage when it is spaced away from an outlet surface of the fuel injector.

16. A system, comprising:

an engine having at least one combustion chamber;

a fuel injector positioned to inject into the at least one combustion chamber, the fuel injector comprising an egg-shaped nozzle having a one or more openings fluidly coupling a hollow interior of the egg-shaped nozzle to the at least one combustion chamber; and a controller with computer readable-instructions stored on non-transitory memory thereof that when executed enable the controller to:

press the egg-shaped nozzle against an outlet surface of the fuel injector in a first position; and move the egg-shaped nozzle away from the outlet surface of the fuel injector in a second position.

17. The system of claim 16, wherein the second position further comprising an outlet passage forming between the egg-shaped nozzle and the outlet surface, wherein the outlet passage comprises an annular venturi shape.

18. The system of claim 17, further comprising a plurality of passages extending from a sac of the fuel injector to the outlet passage, and where the one or more openings of the egg-shaped nozzle comprises a first opening and a plurality of second openings, and where the plurality of second openings are closer to the combustion chamber in the first position than outlets of the plurality of passages, and where the plurality of second openings are farther from the combustion chamber in the second position than the outlets of the plurality of passages.

19. The system of claim 16, wherein the one or more openings comprise a first opening aligned with a central axis of the fuel injector, further comprising a plurality of second openings radially spaced away from the central axis of the fuel injector.

20. The system of claim 19, wherein the first opening is configured to only admit gases into the hollow interior, and where the plurality of second openings are configured to only expel gases from the hollow interior.

* * * * *